United States Patent [19]

Looser

[11] Patent Number: 4,852,820

[45] Date of Patent: Aug. 1, 1989

[54] WINDING METHOD AND APPARATUS

[76] Inventor: Gottlieb Looser, In der Finne 910, FL-9496 Balzers, Liechtenstein

[21] Appl. No.: 126,856

[22] Filed: Nov. 30, 1987

[30] Foreign Application Priority Data

Dec. 4, 1986 [CH] Switzerland ..... 4840/86
Jun. 19, 1987 [CH] Switzerland ..... 2323/87

[51] Int. Cl.[4] ..... B65H 11/20

[52] U.S. Cl. ..... 242/56 R; 242/56 A; 242/65; 226/94

[58] Field of Search ..... 242/56 R, 56 A, 66, 242/65g30; 226/94

[56] References Cited

U.S. PATENT DOCUMENTS

| | | | |
|---|---|---|---|
| 2,256,082 | 9/1941 | Feurt | 242/56 A |
| 3,346,253 | 10/1967 | Paschke | 226/94 |
| 4,046,842 | 9/1977 | Groves et al. | 226/94 X |
| 4,097,323 | 6/1978 | DeRoeck et al. | 242/58.5 X |
| 4,191,341 | 3/1980 | Looser | 242/56 A |
| 4,458,852 | 7/1984 | Calvert et al. | 242/56 A |
| 4,487,377 | 12/1984 | Perini | 242/56.8 |
| 4,678,133 | 7/1987 | Suzuki | 242/56 A |

*Primary Examiner*—Stuart S. Levy
*Assistant Examiner*—Steven M. duBois
*Attorney, Agent, or Firm*—Werner W. Kleeman

[57] ABSTRACT

A method of winding a continuously moving web, such as a flexible polymer film, by forming leading web edges and contacting them in sequence with a number of cores for adhesion thereon so as to start winding consecutive web portions onto the cores; when a web portion of a predetermined length has been wound onto a given core, the web is cut to form both the trailing edge of the wound web portion as well as the leading edge of the next web portion; instead of using a conventional sticky material, such as an adhesive tape, for adhesion of each leading edge of the web on the corresponding core for initiating winding thereof an electrostatic potential difference is provided between the core surface and the leading edge so that the latter will be caused to electrostatically adhere to the core surface.

An apparatus for use in this method comprises a cutting device for separating the moving web and for forming the trailing edge of a preceding portion of the web as well as the leading edge of the next web portion; and a support for rotatably holding a subsequent core close to the web when the next leading edge is formed; the apparatus includes a generator for producing an electrostatic potential difference between each leading edge and the corresponding core for electrostatically adhering the leading edges of the web onto the empty cores.

24 Claims, 3 Drawing Sheets

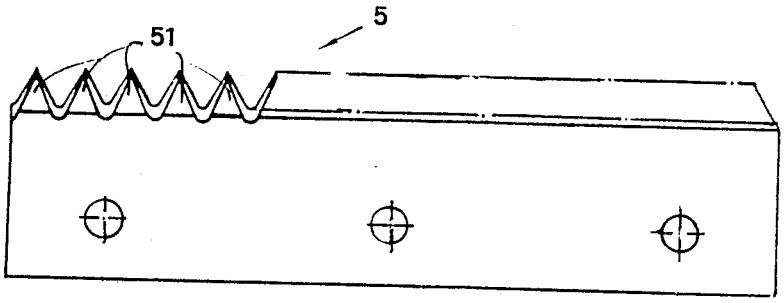
FIG. 5A
FIG. 5B
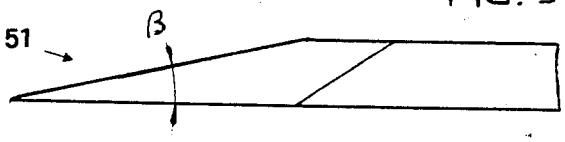
FIG. 5C
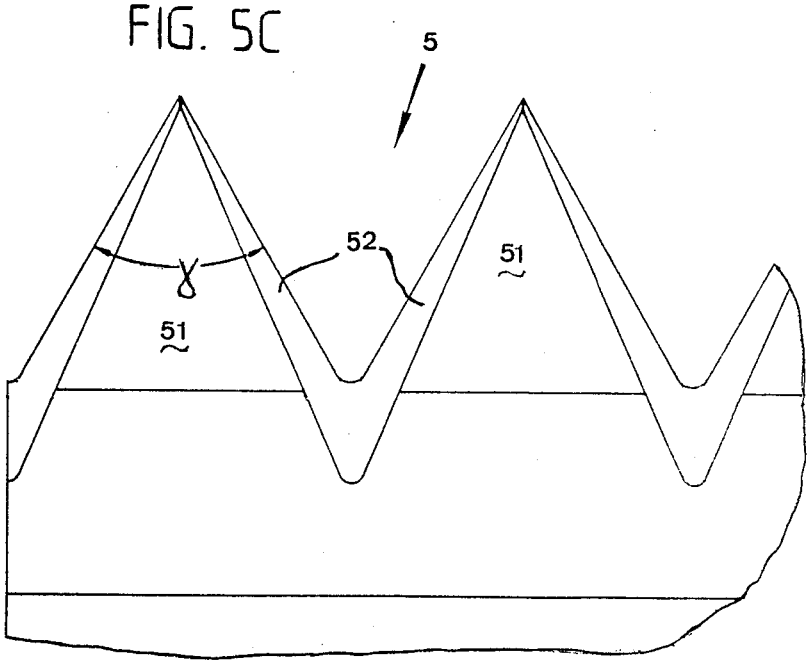

WINDING METHOD AND APPARATUS

BACKGROUND OF THE INVENTION

1. Field of the Invention

This invention relates to the art of manufacturing or processing of continuous webs, such as conventional polymer films, continuously moving at typical elevated speeds of between 10 and 200 meters per minute and which are to be wound onto a sequence of cores normally supplied from an automated core delivery means or magazine and without stopping movement of the web.

2. Description of the Prior Art

Winding machines for continuous operation with flexible webs are well known in the art, cf. U.S. Pat. Nos. 1,687,928; 2,915,255; 3,494,566 and 4,191,341.

A common feature of many prior art winders is a device for receiving and cutting a substantially endless web into portions of predetermined length and for winding each portion onto an empty winding mandrel or core, e.g. rods or tubes made of cardboard, plastic or the like materials.

Generally, cutting means or knives are used to separate a preceding length of the web from a subsequent portion. The leading edge of each web portion is brought into contact with a fresh core, or vice-versa, and a sticky substance or material, typically a double-sided adhesive tape, provided at the core surface is used to fix and hold the leading edge of the web on the core while the latter is rotated to start and continue winding.

A first disadvantage of this conventional approach is that a separate step is needed for applying the adhesive tape or the like sticky substance to the core; another disadvantage is that sticky materials tend to lose or change their adhesive properties, e.g. because of deposition of dust or an unintentional contact upon handling, or due to detrimental effects caused by prolonged storage, temperature impact, and the like condition.

Another essential and functional disadvantage of using conventional sticky materials for adhesion of the leading edges on the cores is that a crepe-like wrinkling effect or a shock-like tensioning of the web may occur due to the instantaneous impact of such adhesion when the core rotates at a peripheral speed that is not exactly the same as the linear speed of the moving web.

OBJECTS OF THE INVENTION

Therefore, it is a primary object of the invention to provide for a method of winding a continuous web of a flexible material onto a sequence of cores without use of sticky materials for causing adhesion of the leading web edges on the corresponding cores.

Another important object of the invention is a novel apparatus that provides for an improved means of holding the leading edge of a moving web on the surface of the corresponding fresh core onto which that leading edge as well as the web portion that starts with it is to be wound.

Still another object of the invention is to improve operation of winding subsequent longitudinal portions of a moving web by providing a novel type of transverse cutter that does not dull as rapidly as many prior art cutters do, notably when operating with polymer films containing antiblocking agents or being known to rapidly dull the cutting edge of conventional knives.

These and other objects will become apparent as this specification proceeds.

SUMMARY OF THE INVENTION

Now in order to implement these and still further objects of the invention, which will become more readily apparent as the description proceeds, the winding method of the present development is manifested, among other things, by the features that, there is provided a leading edge of the continuously moving web and contacted with a core. A predetermined length of the continuously moving web is wound up on the core by providing an electrostatic potential difference between the core and the web when providing or forming said leading edge for electrostatically adhering said leading edge onto the core so as to commence or initiate winding of the web on the core.

As alluded to above, the invention is not only concerned with the aforementioned method aspects, but also relates to a novel construction of apparatus for carrying out the same. Generally speaking, the inventive apparatus comprises means for winding up a continuously moving web of a flexible material having at least one electrically insulating surface onto a number of cores.

To achieve the aforementioned measures, the inventive apparatus, in its more specific aspects and among other things, comprises: a cutter means for cutting said web in an essentially transverse direction to produce a trailing edge of a preceding longitudinal portion of said web and a leading edge of a consecutive longitudinal portion of said web; and a support means for rotatably holding said subsequent core close to said web when said subsequent leading edge is formed; a generator means for producing an electrostatic potential difference between said consecutive leading edge and said consecutive core and for electrostatically adhering said consecutive leading edge to said consecutive core to initiate coil winding.

DISCUSSION OF PREFERRED EMBODIMENTS

Preferably, the web is a virtually endless film of a conventional flexible organic polymer composition having a film thickness in the range of from about 10 to about 500 micrometers ($\mu$m), preferably from about 20 to about 200 $\mu$m, typically made of polyolefins, polyamides, vinylic polymers including polyvinylidene halide polymers, polyesters, polycarbonates and the like film-forming polymers of the homopolymer or copolymer type of consisting of polymer mixtures, optionally containing additives and including coated and/or multilayered films; many such films are of the thermoplastic species but films of cross-linked polymer can be wound according to the invention if they have a flexibility suitable for winding on conventional winders.

Generally, the web should have a dielectric surface or layer capable of maintaining an electrostatic charge and, preferably, the web or film for winding according to the inventive method consists essentially of an electrically insulating material.

The term "electrically insulating" as used herein is synonymous with "dielectric" and is intended to refer to a normally flexible solid having a conductivity at normal room temperature of typically below about $1 \cdot 10^{-1}$ ($Ohms^{-1} \cdot cm^{-1}$).

When operating the invention, leading edges of the web may be formed in a manner known per se or by means of the novel cutter disclosed herein so as to cause web separation in a generally transverse direction; this is understood to include an orthogonal direction relative to the longitudinal axis of the web (or the direction of movement of the web) as well as non-orthogonal directions intersecting with the longitudinal web axis at an angle different from zero. In other words, the length of the leading edge produced upon transverse separation can be equal to the width of the web or be longer than the latter depending upon the angle of intersection.

The leading edge for electrostatic adhesion to the cores wound according to the invention may be the initial web edge or may be any subsequent leading edge formed by transverse web separation and is contacted with a "fresh", i.e. normally empty core while an electrostatic potential difference of typically in the order of several thousand volts, e.g. from 5 KV to 60KV or more, is provided between the core and at least the leading edge portion of the web for electrostatical adhesion so as to commence and continue winding of the subsequent web portion on the corresponding fresh core.

The step of contacting the leading edge with the core surface may be effected but by the electrostatic field caused by the difference of the electrostatic potentials of the web on the one hand, and the core on the other; for permitting safe and continuous operation under varying ambient conditions it is preferred, however, to provide means for mechanically impacting the leading edge so as to accelerate it towards the core as will be discussed in more detail below.

Generally, the electrostatic potential difference between the web, at least in the region of the leading edges of the web portions, and the surface of the fresh cores should be capable, under ambient conditions when practicing the invention, to cause an electrostatic field of sufficient force to hold the leading edge in electrostatic adhesion to the surface of the core for ascertaining that the web will be wound for at least one full turn onto the rotating core such that the next rotation or winding and any subsequent rotation or winding will contribute to building up a coil of web on the core, i.e. to "initiate" the winding operation.

The surface roughness of the core may have an impact but some slippage, at least during the very first part of the initiation of the winding operation, is quite desirable to compensate for differences of the peripheral speed of a rotating core and the speed of movement of the web or of the freshly cut leading edge at the moment of first contact with the surface of the core. Generally, the surface quality of conventional cores made of cardboard, cellulose pulp, or the like is quite suitable for use in accordance with the invention. Preferably, the surface, at least, of the core will be electrically insulating.

According to a first preferred embodiment, the invention is used for winding of polymer films having a web width in the upper range of normal web processing, e.g. in the general range of from about 60 to about 3000 millimeters (mm), preferably in the range from about 500 to about 2500 mm, e.g. as used in normal web producing or web processing plants.

However, according to another embodiment, electrostatic adhesion of the web on the core may be practiced according to the invention for initiating winding in the production of ribbon-type products including simultaneous winding of a plurality of ribbons onto a common core or onto one core for each ribbon; in this case, a typical web width will be in the range of from about 1 to about 50 mm.

The electrostatic potential difference can be generated by electrostatically charging the web and/or the surface of the cores, and commercially available generators of various types can be used. While electrically operated generators are preferred for many purposes of the invention, triboelectric generators are not excluded.

For many purposes of the invention it will be preferred to generate an electrostatic charge on the web while maintaining the core surface at a normal or ground potential. An inverse arrangement will be operable as well and opposite electrostatic charges may be applied both to the web and to the cores.

Typical commercial generators for producing an electrostatic charge on dielectric sheet or web materials by means of dark discharge or corona-type discharge using electrodes in the form of wires, needle points or other geometrical configurations known for electrostatic charging can be used. Typical generators for operation under ordinary plant conditions comprise a connection with a source of current, a transformer for generating a low-current high-voltage output and at least one electrode.

According to a preferred embodiment the method according to the invention comprises the following steps:

(A) providing a first leading edge of the web or film;

(B) providing a first core having a surface to receive said leading edge;

(C) generating an electrostatic potential difference between aid surface of said first core and said first leading edge of said web for temporarily adhering said leading edge onto said surface of said first core;

(D) rotating said first core and electrostatically holding said first leading edge of said web on said surface of said first core to initiate winding of a first elongated portion or length of said web on said first core;

(E) cutting said web in an essentially transverse direction to form a trailing edge of said first length of said web wound on said first core to a leading edge of a subsequent elongated portion or length of said web; and (F) repeating said steps (B) to (E) with said leading edge of said subsequent length of web and a subsequent core for winding said polymer web onto a sequence of cores without interrupting web movement.

In a preferred apparatus according to the invention the electrode or other generator means for electrostatic charging of the web relative to the core is arranged between the cutter and a first core support means; preferably, the cutter includes a toothed blade means arranged substantially transversely to the moving web.

According to a further embodiment, the apparatus for operating the inventive method is part of a winder of the general type disclosed in U.S. Pat. No. 3,494,566 incorporated herein by way of reference and including a conventional winding drum for contacting the web; and an assembly for coaxial rotation with the winding drum; the assembly, in turn, comprises:

(a) means for rotatably holding a core in contact with the web on the winding drum for initiating winding;

(b) a web lifting means which may be a roll or a bar for guiding the web out of contact with the winding drum;

(c) a means for transversely cutting the web, while guided out of contact with the winding drum, to form a trailing edge of a preceding web length and a leading edge of a subsequent web length; and (d) a generator means for producing an electrostatic potential difference between the core in the holding means and the leading edge of the subsequent web length for electrostatically adhering the leading edge onto the core provided in the holding means and for initiating winding of the subsequent web length on that core.

Such apparatus may further include a second holding means into which the core with a first coil portion thereon is transferred and where winding of the coil may be finished by frictional driving of the coil in contact with the winding drum and/or by means of a separate drive for use when operating at low or zero pressures at the nip between coil surface and winding drum and an optional device for controlling the nip pressure as disclosed in the U.S. Patent just mentioned.

Again, the preferred cutter includes a toothed blade as well as a means for pivoting the blade into a path portion of the web when passing between the web lifting means and the core holding means.

When using the preferred cutter that includes a toothed blade, the latter is preferably arranged at an inclination for intersecting with the web such as to include an acute angle of less than 90°, e.g. in the range of 80° and 10°, preferably about 25° to about 45°, between the "downstream" web portion near the lifting means and the blade, or conversely, such as to include an angle of more than 90°, e.g. in the range of from 100° to 170°, preferably about 135° to about 155°, between the blade and the "upstream" web portion near the core holding means where winding is initiated.

In a preferred embodiment of the apparatus, the toothed blade includes a plurality of substantially equidistanced and essentially triangular teeth each having a base length of from about 2 to about 50 mm, an apex height of from about 2 to about 50 mm, a cutting edge angle in the range of from about 5 to about 30° and an enclosed apex angle in the range of from about 30 to about 90°.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIGS. 5A, 5B and 5C are semi-diagrammatic partial views illustrating the preferred toothed cutting blade.

DETAILED DESCRIPTION OF THE PREFERRED EMBODIMENTS

Figure 1:
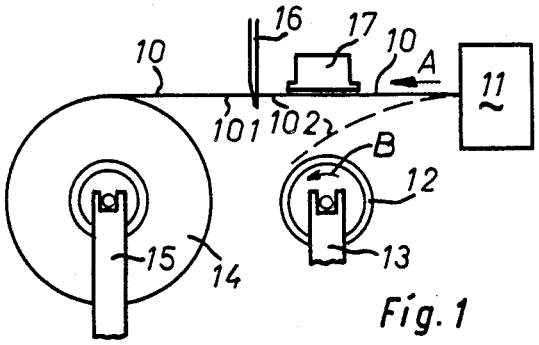
FIG. 1 is a diagrammatic illustration of operating the inventive method.

Describing now the drawings, it is to be understood that only enough of the construction of the web winding apparatus has been shown as needed for those skilled in the art to readily understand the underlying principles and concepts of the present development, while simplifying the showing of the drawings. Turning attention now specifically to FIG. 1 of the drawings, the winding apparatus illustrated therein in a schematic side view by way of example and not limitation will be seen to comprise a web source 11 for feeding a continuously moving web 10. Web 10 of a typical flexible polymer film having a gauge or thickness in the range of from 10 to 200 ∞m emanates from a film producing plant, e.g. an extruder, or a processing apparatus, e.g. a printing plant or a longitudinal cutter that produces two or more webs from a blown hose or a wide web. Web 10 travels in the direction of the arrow A at a typical output rate of the web source 11, e.g. in the range of from 10 to 300 meters per minute or more. It should be noted, however, that the maximum speed of winding according to the invention will not normally be determined by the particular embodiment of the inventive winding apparatus but by the output rate of the web source.

Web 10 passes a generator or electrostatic discharge means 17 for producing an electrostatic potential difference between web 10 second winding and core 12 held in a support means 13 and capable of rotating, e.g. by contact with a winding drum (not shown) or by a separate drive means for core 12, in the direction of arrow B.

Core 12 might either be charged from a source (not shown) electrostatically opposed to the electrostatic charge generated on web 10 by the action of generator 17 or, preferably, is maintained at normal earth potential, e.g. by grounding support 13 and any core mandrel (not shown). Cutting means 16, e.g. a blade capable of being pivoted to intersect with web 10 as shown in FIG. 1 separates web 10 while the latter continues to move to produce the trailing edge 101 of that portion of predetermined length of web 10 which was wound (prior to transverse web separation by cutting means 16) onto coil 14 on a previous or first mandrel or winding core in a second mandrel support 15 at a winding location.

The leading edge portion 102, at least, of web 10 receives an electrostatic charge from generator 17 which will either be in continuous operation or, preferably, be activated but briefly while the cutting means is moved into the path of web 10 for transversal separation thereof. Generator 17 may be any suitable and commercially available generator or electrostatic charger capable of producing a sufficient charge on leading edge 102. The distance between generator and web 10 should be relatively small, e.g. be in the range of typically from 0.5 mm to 50 mm; preferably, generator 17 includes suitable distancing means so as to maintain an optimum distance between its electrode (not shown in FIG. 1) or electrodes, e.g. a line of needle-shaped electrodes transversely arranged relative to the width of web 10 at mutual linear distance between any two adjacent needles, pins, or similar protrusions of typically in the range between 5 to 200 mm. Since core 12 and its surface will either carry an electrostatic charge opposed to that of leading edge 102 or be at normal earth potential, the electrostatically charged leading edge of the subsequent or further predetermined length of web 10 will be attracted by and to the surface of core 12 as indicated in a broken line. Cutting means 16 may include a portion, e.g. a protruding edge (not shown in FIG. 1) that contributes to moving or accelerating the leading edge portion 102 towards the surface of mandrel 12.

With a typical electrostatic potential difference in the range of from about 5 to about 100 Kilovolts between the surface of core 12 and leading edge 102 the latter will be held on the surface of core 12 for at least one full turn of core 12 when rotating in the direction of arrow B and generally for several turns, at least, so that upon further rotations of core 12 a sufficient number of winding layers will have been built up to ascertain that transfer of core 12 from the first or initiating support 13 to a second or main winding support (in a manner known per se and not illustrated in FIG. 1) can be effected without interrupting or slowing the speed of movement of web 10.

As explained above, core 12 has a surface for receiving web 10, e.g. a film of polymer material; by this term it is meant that frictional interaction between the core surface and the contacting surface of web should be selected such that some friction will be caused between the web and the core and that this friction should be sufficient to enable initiation of winding and continuous winding with the particular electrostatic potential difference used in a given embodiment of the inventive method and apparatus. Generally, conventional cores made of cardboard do provide a suitable friction under the specific conditions exemplified herein. When using cores made of other materials, a few simple tests will be sufficient to determine optimal surface and electrostatic charging conditions. Processing and ambient conditions which would cause significant changes of the dielectric properties of the web and/or the core and/or ambient air near the generator and the core should be avoided, of course, since the electrostatic potential difference suitable to initiate winding may not come about or collapse because of substantial changes of dielectric properties of the materials involved.

Figure 2:
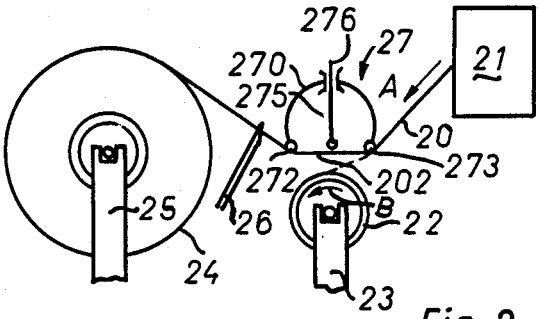
FIG. 2 is a diagrammatic view of a modified way of operating the inventive method.

FIG. 2 shows a view similar to that of FIG. 1 except that the reference numerals of the parts discussed in FIG. 1 carry the FIG. 2 as leading digit. The same holds true, mutatis mutandis, for FIG. 3.

Structural modifications of FIG. 2 concern the predetermined travel path of the web 20 to show that neither a linear path of the web nor a specific side of impact of the cutting means is critical. The generator means 27 of FIG. 2 includes an electrode 275 (or a plurality of electrode points) that is arranged within a housing 270 made of an insulating material and connected with one polar side of a DC high-voltage generator. The other polar side of that generator could be connected with core support 23.

In the aforedescribed embodiments, the cutting means 16 and 26 and the generator 17 and 27 are stationarily arranged at predetermined locations adjacent the predetermined travel path, the generator 17 and 27 being located upstream of the respective cutting means 16 and 27 as viewed in the predetermined travel direction A of the respective continuously moving webs 10 and 20. The support means or core supports 13 and 23 place the respective second winding cores 12 and 22 into a predetermined mutually spaced relationship to the cutting means 16 and 26 and the generators 17 and 27.

Figure 3:
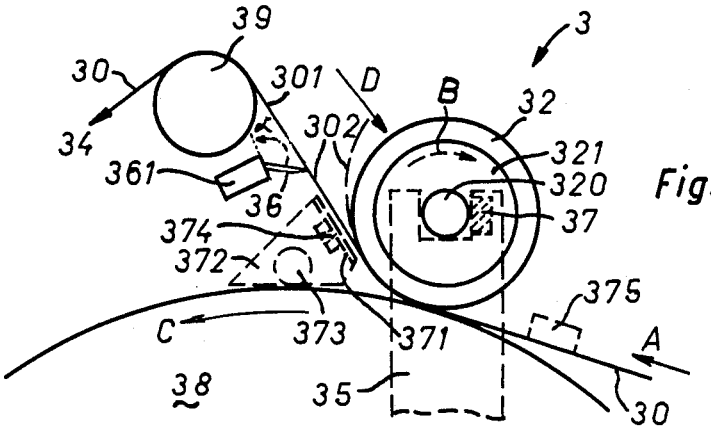
FIG. 3 is a diagrammatic side view of an apparatus according to the invention.

FIG. 3 is a diagrammatic illustration of various methods of generating an electrostatic potential difference and further shows a preferred mode of interaction between cutting means of blade 36 mounted on a blade support at an angle $\alpha$ such that blade 36, when impacting upon web 30, intersects with the trailing edge portion 301 at an acute angle, i.e. less than 90°, typically in the range of from about 10° to about 80°and preferably between about 25° and about 45°; a particularly preferred angle when using the toothed blade as explained below in more detail is about 33°.

The apparatus shown in FIG. 3 further includes a winding drum 38 (only partially shown) and a web lifting means 39 so that web 30 may first contact the surface of drum 38 (also in contact with an empty core 32 held in support 35) and then pass out of contact with the winding drum over the electrode 374 and by cutting blade 36. When blade support 361 and with it blade 36 is moved or pivoted (in a manner not shown in FIG. 3) into the path of web 30, the trailing edge portion 301 of the preceding length of web will pass over lifting means 39 and then towards 34, e.g. to a coil held in a second support (neither shown in FIG. 3).

Leading edge 302 of the consecutive or further predetermined length of web 30 produced by impact of cutting blade 36 will be deflected in the direction of arrow D towards the surface of the second winding of core 32. Such deflection or acceleration can be due, at least in part, to the motion of blade 36 and to some extent to the effect of the electrostatic field caused by charging the leading edge portion 302, at least, of the consecutive length of web 30. While the generator or electrostatic discharge means that includes electrode(s) 374 in a transversal bar or beam 372 optionally supported by a roller 373 on drum 38 (electrical connection of electrode not shown) is preferred, triboelectric generators of an electrostatic field could also be used, e.g. a braking block 37 that could be activated to act upon shaft 320 of core mandrel 321 which in turn carries the empty core 32. Due to the weight of core mandrel 321 the empty core will be pressed onto web 30 supported by winding drum 38 (rotating in the direction of arrow C) and tends to turn therewith in the direction of arrow B. Upon braking the rotation of shaft 320, core 32 will be in frictional contact with web 30 and electrostatic charges of opposed polarity will be built up on web 30, on the one hand, and on the surface of core 32, on the other hand, if the latter is made of a suitable material. Triboelectric charging could also be effected by a rubbing bar 375.

Figure 4A:
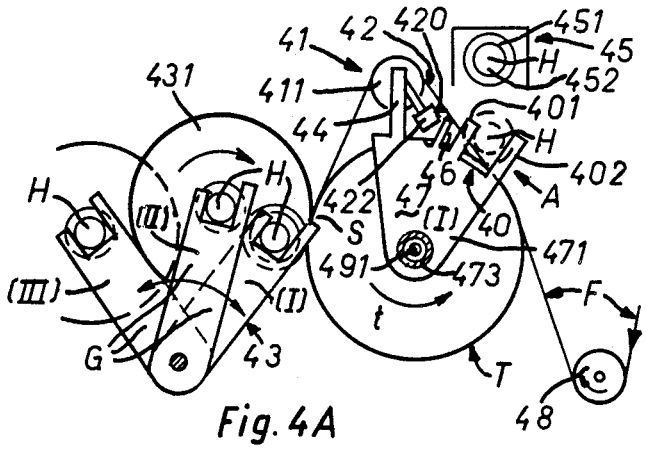
FIGS. 4A, 4B, and 4C are diagrammatic side views of various phases of the operating cycle of an inventive apparatus.
Figure 4B:
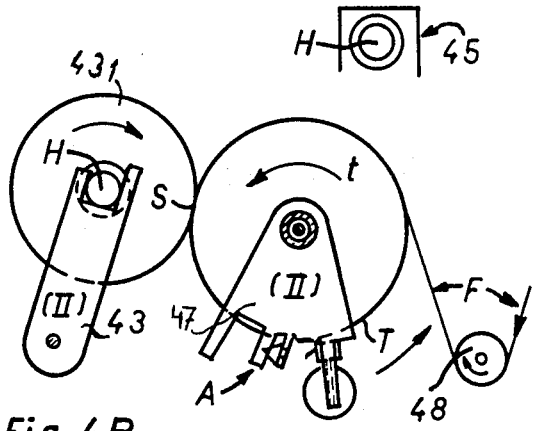

FIGS. 4A and 4B illustrate a preferred apparatus according to the invention for winding of a web of a polymer film F that passes first around a deflecting roller 48 unto a conventional winding drum T rotating in the direction of arrow t. An aggregate A for performing the essential functions illustrated in FIG. 3 is shown in FIG. 4A in a first or 12 o'clock or active position (I) and includes a core H, a web lifting means or device 41, a cutting means 42 and a generator means 46. Empty cores H are delivered from a magazine 45 and each core normally includes a tubular outer portion 451 made, e.g. of cardboard, and a mandrel 452 made of steel.

Lifting device 41 may have a roller 411 or a slide bar and primarily functions to guide film F out of contact with winding drum T; additionally, it may include means to distribute a coating or sizing agent on the film. In any case, the film travels from lifting device 41 to a coil 431 wound onto a preceding or first winding core H rotatingly held in a second core support 43 formed, e.g. by a pair of pivotable arms (only front side part shown). Support 43 is pivotable as shown and moves cyclically from a first position (I) with an initiated coil to a second position (II) with an essentially completed coil and then pivots into a discharge position (III) to remove a finished coil 431. Thereafter, support 43 is returned into position (I) for the next cycle.

The aggregate is either in the active position (I) shown in FIG. 4A or in the inactive position (II), also termed 6 o'clock position, shown in FIG. 4B. To this end it is rotatably supported by means of a holder or common support member 47 on a hollow shaft 473 that surrounds shaft 491 of the winding drum T (drive means not shown). The 6 o'clock position of aggregate A is maintained for the predominant part of any winding cycle while the 12 o'clock position is normally maintained just prior to the start of a coil winding cycle. The first stage is feeding of a fresh or second winding core H from magazine 45 into support 40 formed by two arms 401 and 402. The fresh core H in support 40 starts to rotate because of frictional engagement with film F nd rotating drum T. Now, the cutting device 42 is actuated by a pivoting mechanism 44 (explained in more detail in FIG. 4C). While the trailing edge of the preceding length of film thus generated travels onto coil 431 (so that the latter is finished and can be removed by pivoting support 43 into position (III), the leading edge 421 of the subsequent length of film F is electrostatically adhered to the fresh core H in support 40.

Thus, in the active position (I) of the holder or common support member 47, the cutting means 42 and the generator or electrostatic discharge means 46 are substantially stationarily arranged upstream of web lifting means 41 and the electrostatic discharge means 46 is located upstream of the cutting means 42 as viewed in the predetermined travel direction of the continuously moving film F. The second winding core H is arranged in a predetermined mutually spaced relationship to the cutting means 42 and the electrostatic discharge means 46. Due to its movement from the active position (I), see FIG. 4A, into the inactive position (II), see FIG. 4B, the holder or common support member 47 also acts as a displacement means for displacing and delivering the second winding core H to the second core support 43 at the winding location.

Figure 4C:
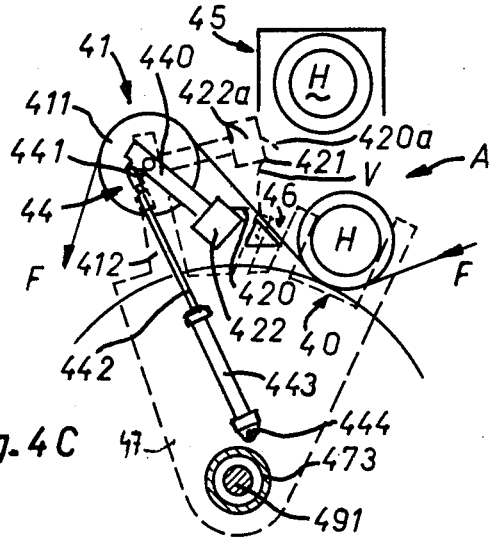

FIG. 4C shows the details of a pivoting device 44 suitable for actuating the cutting means. Cutting blade 420 is mounted, preferably in an easily replaceable manner, on a blade support or bar 422 which in turn is connected by lateral arms 440 (only front arm shown) that are pivotably supported by shaft 441 of the roller 411 of the web lifting means 41. A pneumatic cylinder 443 or the like actuating means is secured on holder 47 by means of a pin 444. When cylinder 443 is actuated (pneumatic connections not shown) it will retract rod 442. The latter is connected excentrically with arm 440 so that the blade holder 422 and with it blade 420 will be moved to intersect with the path of film F to effect transverse web separation and to accelerate the leading edge V towards the surface of core H held in support 40. While actuating cylinder 443 for pivoting blade 422 into and through cutting action, generator means 46 will be actuated in the manner described above for electrostatic adhesion of film F onto the empty core H.

FIGS. 5A, 5B and 5C illustrate a preferred embodiment of the toothed cutting blade 5. FIG. 5A shows a semi-diagrammatic top view of blade 5 having a multiplicity of essentially triangular protrusions or teeth 51. While only five teeth 51 are actually shown, it will be understood that substantially the entire length of blade 5 will have such teeth. Perforations or other suitable positioning means for mounting blade 5 on its support (not shown in FIG. 5) and for easy exchange to avoid use of dulled blades are provided.

FIG. 5C is an enlarged view of FIG. 5A to show how cutting faces or edges 52 can be formed, e.g. by grinding the raw blade on one side or both sides of each triangular protrusion 51.

Generally, each triangular protrusion or tooth 51 will have a base length of from about 2 to about 50 mm, an apex heigt of from about 2 to about 50 mm, a cutting edge angle $\alpha$ in the range of from about 5 to about 30° and an enclosed apex ($\alpha$) angle in the range of from about 30 to about 90°.

EXAMPLE

A winder of the type illustrated in U.S. Pat. No. 4,191,341 was modified in that the web separating means 77 of FIG. 7 thereof was designed essentially as shown in FIGS. 4A to 4C with a toothed blade according to FIG. 5A herein.

The generator means 46 included a commercially available charging rod comprising a multi-pin electrode with pin distances of 15 mm. The generator was supplied with a primary voltage of 240 V at 50 VA; the output current was a DC of 60 KV at 3 mA (measured upon shortage). The core support was in conductive connection with each core mandrel so that the latter were at normal ground potential.

The apparatus was used to wind polyethylene (LLDPE) with gauges ranging from 10 $\mu$m to 150 $\mu$m. The cores were standard cardboard cores (3 inch type) and the web width was 2800 mm. The winding cores operated faultlessly without application of any sticky adhesive simply by electrostatic adhesion. When the current supply to the generator means was interrupted, winding of the fresh cores cold not be initiated and the machine had to be stopped.

Suitable modifications can be made to the method and apparatus described herein without departing from the inventive concept. So, while certain preferred embodiments of the invention have been explained in some detail for illustration it is to be understood that the invention is not limited thereto but may be otherwise embodied and practiced within the scope of the following claims.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of winding a continuously moving web of a flexible material having at least one electrically insulating surface, comprising the steps of:

feeding the continuously moving web along a predetermined travel path in a predetermined travel direction past electrostatic discharge means and cutting means to a first winding core located at a winding location for forming a coil from said continuously moving web;

winding up a predetermined length of said continuously moving web on said first winding core and thereby forming said coil from said continuously moving web;

substantially stationarily placing, at least in their active position, said electrostatic discharge means and said cutting means at predetermined locations adjacent said predetermined travel path of said continuously moving web;

prior to completely winding up said predetermined length of said continuously moving web on said first winding core, placing a second winding core into a predetermined mutually spaced relationship to said electrostatic discharge means and said cutting means;

upon reaching said predetermined length of said continuously moving web, moving said cutting means through a cutting stroke in order to cut through said continuously moving web and thereby form a trailing edge of said predetermined length of said continuously moving web and a leading edge of a further predetermined length of said continuously moving web to be wound up on said second winding core;

substantially simultaneously with said cutting stroke, energizing said electrostatic discharge means for producing an electrostatic potential difference between said leading edge of said further predetermined length of said continuously moving web and second winding core;

adhering said leading edge of said further predetermined length of said continuously moving web to said second winding core under the action of said predetermined electrostatic potential difference and winding up at least one layer of said continuously moving web on said second winding core; and removing said first winding core from said winding location and placing said second winding core into said winding location for winding up said further predetermined length of said continuously moving web on said second winding core.

2. The method as defined in claim 1, wherein:

said step of substantially stationary placing said electrostatic discharge means and said cutting means, at least in their active positions, at said predetermined locations entails substantially stationarily arranging said electrostatic discharge means and said cutting means at said predetermined locations adjacent said predetermined travel path of said continuously moving web.

3. The method as defined in claim 1, further including the steps of:

arranging said electrostatic discharge means, said cutting means and support means for rotatably supporting said second winding core on a common support member at a predetermined mutually spaced relationship;

displacing said common support member between an inactive position remote from said predetermined travel path of said continuously moving web and an active position adjacent said predetermined travel path of said continuously moving web; and said step of placing said second winding core into said predetermined mutually spaced relationship to said electrostatic discharge means and said cutting means, entailing the step of placing said second winding core into said support means of said common support member in said active position of said common support member.

4. The method as defined in claim 3, further including the steps of:

rotatably driving said first winding core at said winding location and said second winding core placed in said support means at said common support member, by using a common winding drum having a shaft;

said step of displacing said common support member between its inactive and active positions entailing the step of rotating said common support member about said shaft of said common winding drum; and displacing said common support member from said active position into said inactive position and thereby placing said second winding core into said winding location.

5. The method of claim 1, further including the step of selecting as said continuously moving web a film of a polymer material.

6. The method of claim 1, wherein said step of adhering said leading edge of said further predetermined length of said continuously moving web to said second winding core entails receiving said leading edge at said second winding core at an outer surface of a material that is essentially non-conductive for electricity.

7. The method of claim 1, wherein said step of producing said electrostatic potential difference entails electrostatically charging said web relative to said core.

8. The method of claim 7 wherein said step of producing the electrostatic potential difference between said leading edge of said further predetermined length of said continuously moving web and said second winding core entails producing as said potential difference a potential difference in the range of from about 5 to about 60 kilovolts.

9. The method of claim 5, wherein said step of selecting said film of a polymer material entails selecting a film of a polymer material having a thickness in the range of from about 10 to about 500 micrometers.

10. The method of claim 9, wherein said step of selecting said thickness includes selecting a thickness in the range of from about 20 to about 200 micrometers.

11. The method of claim 1, wherein said step of feeding said continuously moving web entails feeding a web having a width in the range of from about 1 to about 50 mm.

12. The method of claim 1, wherein said step of feeding said continuously moving web entails feeding a web having a width in the range of from about 50 mm to about 3000 mm.

13. An apparatus for winding a continuously moving web of a flexible material having at least one electrically insulating surface, comprising:

a web source for feeding the continuously moving web along a predetermined travel path in a predetermined travel direction to a first winding core located at a winding location for forming a coil from said continuously moving web on said first winding core;

a winding drum drivingly engaging said first winding core for forming said coil from said continuously moving web;

web lifting means for lifting said continuously moving web from said winding drum and directing said continuously moving web from said winding drum to said first winding core located at said winding location;

electrostatic discharge means and cutting means substantially stationarily located, at least in their active positions, at predetermined locations adjacent said predetermined travel path of said continuously moving web and upstream of said web lifting means as viewed in said predetermined travel direction of said continuously moving web;

said electrostatic discharge means being arranged upstream of said cutting means as viewed in said predetermined travel direction of said continuously moving web;

said cutting means, during operation, moving through a cutting stroke for cutting through said continuously moving web moving along said predetermined travel path in order to form a trailing edge of a predetermined length of said continuously moving web and a leading edge of a further predetermined length of said continuously moving web;

support means for rotatably supporting a second winding core in a predetermined mutually spaced relationship to said electrostatic discharge means and said cutting means and upstream of said electrostatic discharge means as viewed in said predetermined travel direction of said continuously moving web;

said continuously moving web passing between said winding drum and said second winding core such that said second winding core is drivingly engaged by said winding drum through said continuously moving web;

said electrostatic discharge means, during said cutting stroke of said cutting means being energized for producing an electrostatic potential difference between said leading edge of said further predetermined length of said continuously moving web and said second winding core in order to electrostatically adhere said leading edge of said further predetermined length of said continuously moving web to said second winding core; and displacing means for displacing said support means for rotatably supporting said second winding core when containing at least one layer of said further predetermined length of said continuously moving web, to said winding location, after removal from said winding location of a completed roll formed by said predetermined length of said continuously moving web on said first winding core.

14. The apparatus as defined in claim 13, wherein:

said electrostatic discharge means and said cutting means being substantially stationarily arranged at said predetermined locations adjacent said predetermined travel path of said continuously moving web.

15. The apparatus as defined in claim 13, further including:

a common support member supporting said electrostatic discharge means, said cutting means and said support means for rotatably supporting said second winding core; and said displacing means for displacing said second winding core constituting displacement means for displacing said common support member between an inactive position in which said electrostatic discharge means, said cutting means and said support means are placed remote from said predetermined travel path of said continuously moving web, and an active position in which said electrostatic discharge means and said cutting means are located at said predetermined locations adjacent said predetermined travel path and said support means are placed in said predetermined mutually spaced relationship to said electrostic discharge means and said cutting means.

16. The apparatus as defined in claim 15, further including:

a shaft of said winding drum;

said common support member being rotatably supported at said shaft of said winding drum; and drive means for rotating said common support member about said shaft of said winding drum and constituting said displacement means for displacing said common support member between its active and inactive positions and thereby placing said second winding core into said winding location.

17. The apparatus of claim 13, wherein said electrostatic discharge means includes a means for electrostatically charging said continuously moving web relative to said core upstream of said cutting means as viewed in said predetermined travel direction of said continuously moving web.

18. The apparatus of claim 13, wherein said electrostatic discharge means includes an electrode for producing electrostatic charges near said leading edge of said further predetermined length of the continuously moving web.

19. The apparatus of claim 13 wherein said cutting means includes a toothed blade means arranged substantially transverse to said continuously moving web.

20. The apparatus of claim 17, wherein said cutting means includes a toothed blade and pivoting means for pivoting said toothed blade through said cutting stroke.

21. The apparatus of claim 20 wherein said cutting means act as impact means for deflecting said leading edges of said further predetermined length of said continuously moving web toward said second winding core.

22. The apparatus of claim 20 wherein said toothed blade is arranged at an inclination for intersecting with said continuously moving web at a position thereof at an angle of less than 90°.

23. The apparatus of claim 22 wherein said toothed blade is arranged at an inclination for intersecting with said continuously moving web at an angle of between about 25 to about 45°.

24. The apparatus of claim 20 wherein said toothed blade includes a plurality of substantially triangular teeth each having a base length of from about 2 to about 50 mm, an apex height of from about 2 to about 50 mm, a cutting edge angle in the range of from about 5 to about 30° and an enclosed apex angle in the range of from about 30 to about 90°.

* * * * *